US012616347B2

(12) United States Patent
Yang

(10) Patent No.: US 12,616,347 B2
(45) Date of Patent: May 5, 2026

(54) BIDIRECTIONAL CLEANING MACHINE

(71) Applicant: ZHEJIANG PRULDE ELECTRIC APPLIANCE CO., LTD., Jinhua (CN)

(72) Inventor: Weiming Yang, Jinhua (CN)

(73) Assignee: ZHEJIANG PRULDE ELECTRIC APPLIANCE CO., LTD., Jinhua (CN)

( * ) Notice: Subject to any disclaimer, the term of this patent is extended or adjusted under 35 U.S.C. 154(b) by 504 days.

(21) Appl. No.: 18/687,304

(22) PCT Filed: May 14, 2021

(86) PCT No.: PCT/CN2021/093759
§ 371 (c)(1),
(2) Date: Feb. 28, 2024

(87) PCT Pub. No.: WO2022/183597
PCT Pub. Date: Sep. 9, 2022

(65) Prior Publication Data

US 2024/0215786 A1 Jul. 4, 2024

(30) Foreign Application Priority Data

Mar. 2, 2021 (CN) ..... 202110231219.2

(51) Int. Cl.
*A47L 11/283* (2006.01)
*A47L 11/40* (2006.01)
(Continued)

(52) U.S. Cl.
CPC ..... *A47L 11/283* (2013.01); *A47L 11/4038* (2013.01); *A47L 11/4069* (2013.01); *A47L 11/4075* (2013.01)

(58) Field of Classification Search
CPC ..... A47L 11/283; A47L 11/4038; A47L 11/4069; A47L 11/4075; A47L 11/40; B08B 1/36; B08B 1/32; B63B 59/06
See application file for complete search history.

(56) References Cited

U.S. PATENT DOCUMENTS 1,827,905 A * 10/1931 Picker ..... A47L 11/293 15/99
4,365,378 A * 12/1982 Springer ..... A47L 11/164 451/490
(Continued)

FOREIGN PATENT DOCUMENTS

CN 2757723 Y * 2/2006
CN 2845697 Y * 12/2006
(Continued)

*Primary Examiner* — Marc Carlson
(74) *Attorney, Agent, or Firm* — Bayramoglu Law Offices LLC

(57) ABSTRACT

A bidirectional cleaning machine includes a cleaning mechanism and a handle. The cleaning mechanism includes a housing, a transmission shaft is mounted in the housing, a first gear is arranged on the transmission shaft, and one end of the transmission shaft is fixedly connected to an inner cleaning disk; the transmission shaft is sleeved with a transmission sleeve, and one end of the transmission sleeve is perpendicularly and fixedly connected to an outer cleaning ring; a base gear is fixedly arranged on the transmission sleeve, and a fixed gear is fixedly arranged in the housing; connecting shafts are perpendicularly arranged on the base gear, and each connecting shaft is sleeved with a second gear and a third gear; a power mechanism is arranged on the housing; clamping rings configured as circular structures are arranged a side face of the housing, teeth are distributed on inner sides of the clamping rings.

8 Claims, 4 Drawing Sheets

(51) Int. Cl.

| | |
|---|---|
| ***B08B 1/32*** | (2024.01) |
| ***B08B 1/36*** | (2024.01) |
| ***B63B 59/06*** | (2006.01) |

(56) References Cited

U.S. PATENT DOCUMENTS

| | | | | |
|---|---|---|---|---|
| 2013/0180547 | A1* | 7/2013 | Kent | A46B 5/005 134/6 |
| 2022/0409003 | A1* | 12/2022 | Protz | A47L 11/4038 |

FOREIGN PATENT DOCUMENTS

| | | | | | |
|---|---|---|---|---|---|
| CN | 102908113 | A | * | 2/2013 | |
| CN | 203505890 | U | * | 4/2014 | |
| CN | 105993369 | A | * | 10/2016 | A01D 34/74 |
| CN | 210138111 | U | * | 3/2020 | |
| CN | 210673221 | U | * | 6/2020 | |
| CN | 111449581 | A | * | 7/2020 | A47L 11/4038 |
| CN | 212281207 | U | * | 1/2021 | |
| JP | 2002320580 | A | * | 11/2002 | |
| WO | WO-2019192482 | A1 | * | 10/2019 | B08B 3/02 |

* cited by examiner

BIDIRECTIONAL CLEANING MACHINE

CROSS REFERENCE TO THE RELATED APPLICATIONS

This application is the national phase entry of International Application No. PCT/CN2021/093759, filed on May 14, 2021, which is based upon and claims priority to Chinese Patent Application No. 202110231219.2, filed on Mar. 2, 2021, the entire contents of which are incorporated herein by reference.

TECHNICAL FIELD

The invention belongs to the technical field of cleaning machines, in particular to a bidirectional cleaning machine.

BACKGROUND

Floors, bottom plates, hulls and other positions need to be cleaned frequently by means of tools such as mops. Traditional mops have an unsatisfactory cleaning effect and need to be dragged back and forth frequently, which is labor-consuming. To save labor, automatic cleaning machines with a mop head capable of rotating automatically appear on the market. Compared with traditional mops, the automatic cleaning machines have a better cleaning effect and easier to use. However, the cleaning disk of existing cleaning machines can only rotate in one direction and has a moderate cleaning effect on some stubborn stains, thus failing to satisfy use requirements; in addition, the handle on existing cleaning machines is fixedly connected to the cleaning machines, and the angle between the handle and the cleaning machines cannot be adjusted, making the cleaning machines inconvenient to use.

SUMMARY

In view of the defects of unsatisfactory cleaning effect and inconvenience in cleaning of cleaning machines in the prior art, the invention provides a bidirectional cleaning machine. An inner cleaning disk and an outer cleaning ring of the bidirectional cleaning machine can rotate synchronously in opposite directions, such that the cleaning effect is better; and the angle between a handle and a cleaning mechanism can be adjusted according to personal requirements, such that the bidirectional cleaning machine is convenient to use.

The objective of the invention is fulfilled through the following technical solution: a bidirectional cleaning machine includes a cleaning mechanism and a handle;

the cleaning mechanism includes a housing, a transmission shaft only allowed to rotate around its axis is mounted in the housing, a first gear located in the housing is fixedly arranged on the transmission shaft, and an end of the transmission shaft stretches out of the housing and is fixedly connected to an inner cleaning disk; the transmission shaft is sleeved with a transmission sleeve which is only allowed to rotate around its axis, an end of the transmission sleeve stretches out of the housing and is perpendicularly and fixedly connected to an outer cleaning ring, and the outer cleaning ring is disposed around the inner cleaning disk; a base gear located in the housing is fixedly arranged on the transmission sleeve, and a fixed gear coaxial with the transmission shaft is fixedly arranged in the housing; at least two connecting shafts which are distributed in a circular array around the transmission shaft are perpendicularly arranged on the base gear, each connecting shaft is sleeved with a second gear and a third gear which are able to rotate around a central line of the connecting shaft, the second gear and the third gear are fixedly connected, the second gear meshes with the first gear, and the third gear meshes with the fixed gear; a power mechanism for driving the base gear to rotate is fixedly arranged on the housing; clamping rings configured as circular structures are fixedly arranged a side face of the housing, teeth are distributed on inner sides of the clamping rings, the handle is rotatably connected between central lines of the clamping rings on the housing, connecting pieces only allowed to slide in a radial direction of the clamping rings are slidably connected to the handle, a clamping piece which is located on the inner side of the corresponding clamping ring and able to mesh with the teeth on the corresponding clamping ring is fixedly arranged at an end of each connecting piece, a button is fixedly arranged at outer ends of the connecting pieces, and a spring for driving the clamping pieces to move towards the teeth is arranged between the handle and the button.

In the above solution, when the cleaning mechanism operates, the power mechanism drives the base gear to rotate, and the inner cleaning disk and the outer cleaning ring are finally driven to rotate synchronously in opposite directions through rotation of other components, such that bidirectional rotation is realized, and compared with cleaning machines with a cleaning disk capable of rotating in one direction, the bidirectional cleaning machine provided by the invention has a better cleaning effect. Users can rotate the handle to adjust the relative angle between the handle and a body of the cleaning machine only by pressing the button; after adjustment, the button can be released, and the clamping pieces mesh with the teeth under the action of the spring to lock the handle and the body of the cleaning machine, such that the cleaning machine can be operated easily.

Preferably, a through groove is formed in the handle, and the button is arranged in the through groove.

Preferably, one clamping ring is fixedly arranged on each of two sides of the housing, two connecting pieces are arranged and are in one to-to-one correspondence with the two clamping rings, and outer ends of the two connecting pieces are fixed to the same button.

Preferably, a fixing ring which is fixed to the housing and configured as a circular structure is arranged in each clamping ring, the fixing rings are coaxial with the clamping rings, the clamping pieces are located between the fixing rings and the clamping rings, two parallel connecting plates are fixedly arranged on the handle, a retaining ring configured as a circular structure is fixedly arranged on an inner side of each connecting plate, an outer diameter of the retaining rings is equal to an inner diameter of the fixing rings, the two connecting plates are arranged on two sides of the housing respectively, the two retaining rings on the two connecting plates are sleeved with the two fixing rings respectively, and the handle is rotatably connected to the housing by means of the retaining rings and the fixing rings.

Preferably, a connecting ring configured as a circular structure is arranged above the base gear and disposed around the fixed gear, upper ends of the connecting shafts are fixedly connected to the connecting ring, and the number of the connecting shafts is three. By means of the connecting ring, operation is more stable when the connecting shafts rotate with the base gear.

Preferably, an upper end of the transmission shaft is sleeved with the fixed gear and is only allowed to rotate around its axis.

Preferably, a diameter of the second gear is greater than a diameter of the third gear, the diameter of the first gear is less than a diameter of the fixed gear, and the diameter of the fixed gear is greater than the diameter of the third gear.

Preferably, the power mechanism includes a shell fixed to a side face of the housing, a motor and a reducer are fixedly arranged in the shell, a rotating shaft of the motor is connected to an input end of the reducer, and a moving gear meshing with the base gear is arranged at an output end of the reducer.

Preferably, central lines of the fixing rings are perpendicular to a length direction of the power mechanism.

Preferably, a lower surface of the inner cleaning disk is flush with a lower surface of the outer cleaning ring.

Compared with the prior art, the invention has the following beneficial effects: the inner cleaning disk and the outer cleaning ring of the bidirectional cleaning machine can rotate synchronously in opposite directions, such that bidirectional rotation is realized to fulfill a better cleaning effect; and the angle between the handle and the cleaning mechanism can be adjusted according to personal requirements, and the handle and the cleaning mechanism can be locked after adjustment, such that operation is easy.

Figure 1:
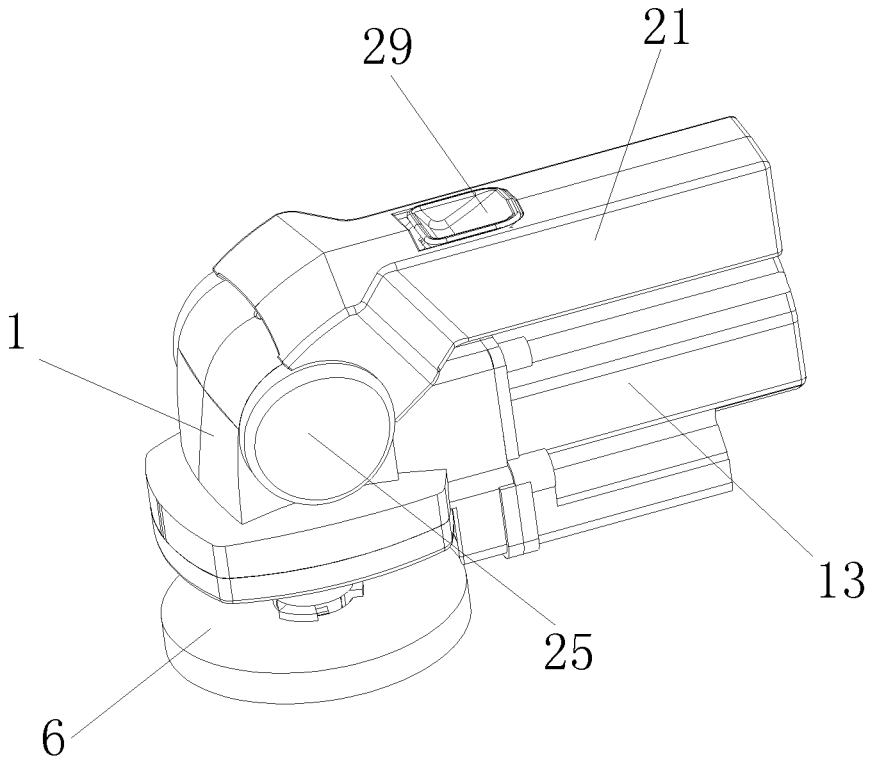
FIG. 1 is a three-dimensional view of the invention.

Reference signs: 1, housing; 2, transmission shaft; 3, first gear; 4, inner cleaning disk; 5, transmission sleeve; 6, outer cleaning ring; 7, base gear; 8, fixed gear; 9, connecting shaft; 10, second gear; 11, third gear; 12, connecting ring; 13, shell; 14, motor; 15, reducer; 16, moving gear; 21, handle; 22, clamping ring; 23, teeth; 24, fixing ring; 25, connecting plate; 26, retaining ring; 27, connecting piece; 28, clamping piece; 29, button; 30, spring; 31, through groove.

DETAILED DESCRIPTION OF THE EMBODIMENTS

The invention will be further described below in conjunction with embodiments illustrated by the accompanying drawings.

Embodiment 1

As shown in FIG. 1-FIG. 5, a bidirectional cleaning machine includes a cleaning mechanism and a handle 21, wherein the cleaning mechanism includes a housing 1, a transmission shaft 2 only allowed to rotate around its axis is mounted in the housing 1, a first gear 3 located in the housing 1 is fixedly arranged on the transmission shaft 2, and one end of the transmission shaft 2 stretches out of the housing 1 and is fixedly connected to an inner cleaning disk 4; the transmission shaft 2 is sleeved with a transmission sleeve 5 which is only allowed to rotate around its axis, one end of the transmission sleeve 5 stretches out of the housing 1 and is perpendicularly and fixedly connected to an outer cleaning ring 6, the outer cleaning ring 6 is disposed around the inner cleaning disk 4, and a lower surface of the inner cleaning disk 4 is flush with a lower surface of the outer cleaning ring 6. A base gear 7 located in the housing 1 is fixedly arranged on the transmission sleeve 5, a fixed gear 8 coaxial with the transmission shaft 2 is fixedly arranged in the housing 1, and an upper end of the transmission shaft 2 is sleeved with the fixed gear 8 and is only allowed to rotate around its axis. Three connecting shafts 9 which are distributed in a circular array around the transmission shaft 2 are perpendicularly and fixedly arranged on the base gear 7, each connecting shaft 9 is sleeved with a second gear 10 and a third gear 11 which are able to rotate around a central line of the connecting shaft 9, the second gear 10 and the third gear 11 are fixedly connected, the second gear 10 meshes with the first gear 3, and the third gear 11 meshes with the fixed gear 8. The diameter of the second gear 10 is greater than the diameter of the third gear 11, the diameter of the first gear 3 is less than the diameter of the fixed gear 8, and the diameter of the fixed gear 8 is greater than the diameter of the third gear 11. A connecting ring 12 configured as a circular structure is arranged above the base gear 7 and disposed around the fixed gear 8, and upper ends of the connecting shafts 9 are fixedly connected to the connecting ring 12.

Figure 3:
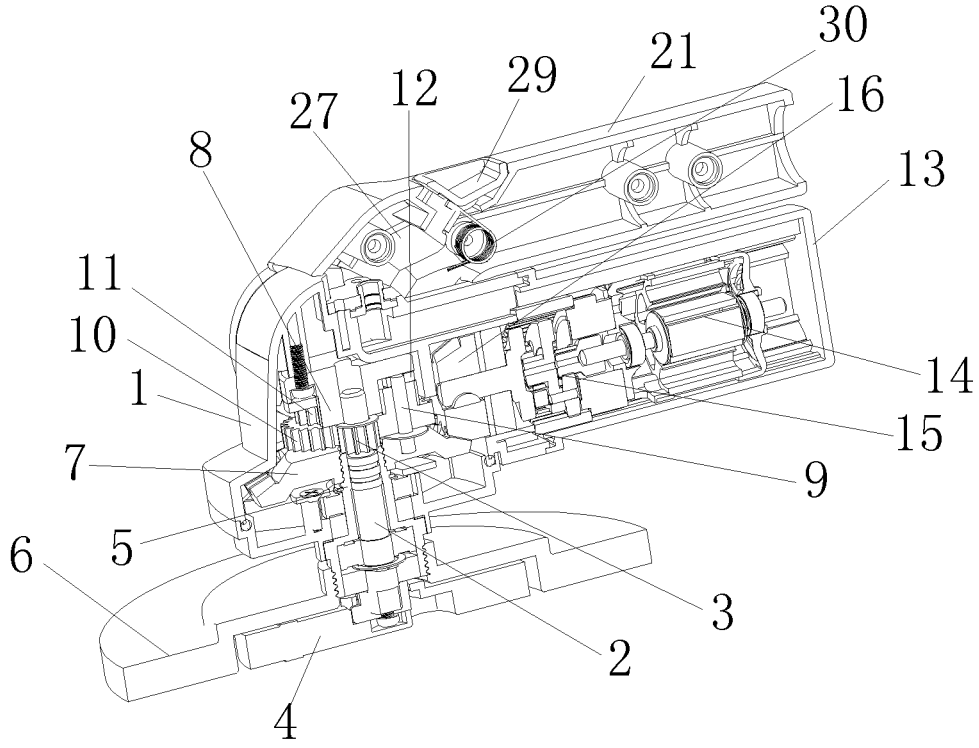
FIG. 3 is a partial sectional view of the invention.

As shown in FIG. 3, a power mechanism for driving the base gear 7 to rotate is fixedly arranged on the housing 1. The power mechanism includes a shell 13 fixed to a side face of the housing 1, a motor 14 and a reducer 15 are fixedly arranged in the shell 13, a rotating shaft of the motor 14 is connected to an input end of the reducer 15, and a moving gear 16 meshing with the base gear 7 is arranged at an output end of the reducer 15.

Figure 2:
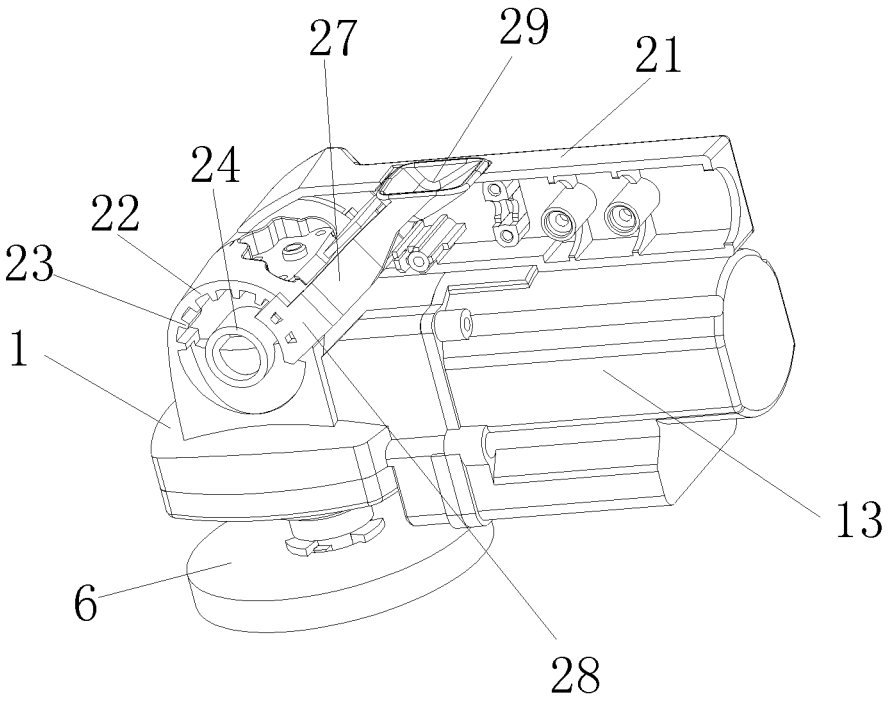
FIG. 2 is an internal structural view of the invention.
Figure 4:
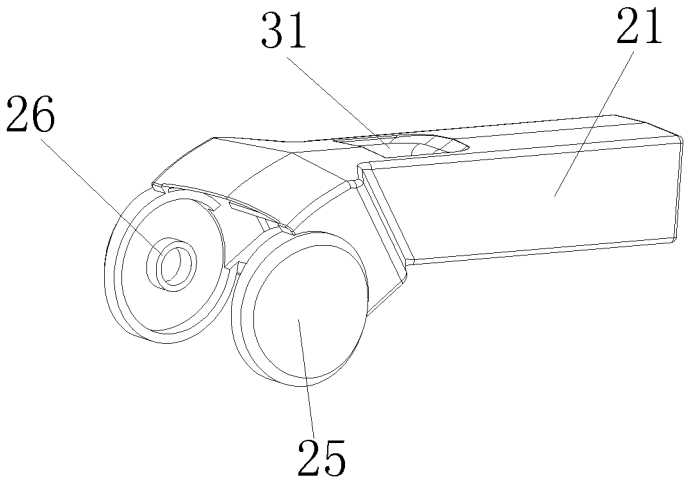
FIG. 4 is a three-dimensional view of a handle.

As shown in FIG. 2 and FIG. 4, a clamping ring 22 configured as a circular structure is fixedly arranged on each of two sides of the housing 1, teeth 23 are distributed on an inner side of the clamping ring 22, a fixing ring 24 which is fixed to the housing 1 and configured as a circular structure is arranged in the clamping ring 22, and the fixing ring 24 is coaxial with the clamping ring 22. Two parallel connecting plates 25 are fixedly arranged on the handle 21, a retaining ring 26 configured as a circular structure is fixedly arranged on an inner side of each connecting plate 25, the outer diameter of the retaining ring 26 is equal to the inner diameter of the fixing ring 24, the two connecting plates 25 are arranged on two sides of the housing 1 respectively, the two retaining rings 26 on the two connecting plates 25 are sleeved with the two fixing rings 24 respectively, and the handle 21 is rotatably connected to the housing 1 by means of the retaining rings 26 and the fixing rings 24.

Figure 5:
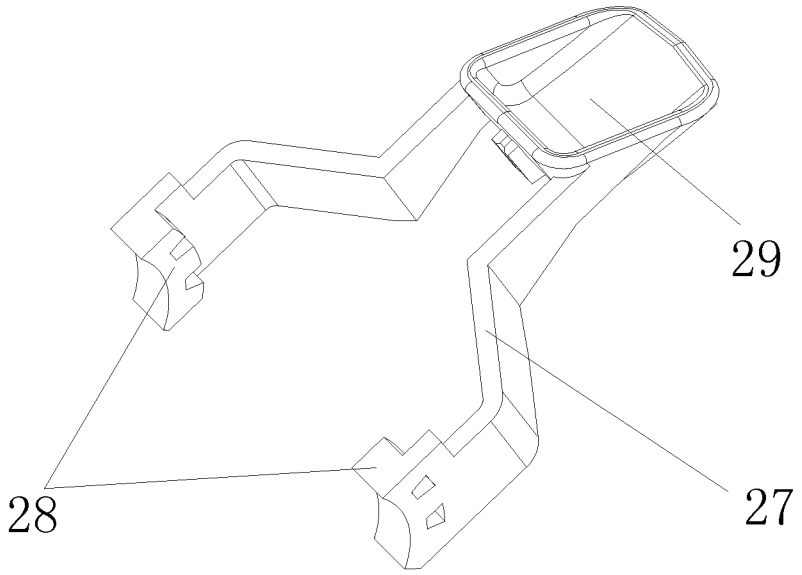
FIG. 5 is a connection structural view of connecting pieces, clamping pieces and a button.

As shown in FIG. 2, FIG. 3 and FIG. 5, two connecting pieces 27 are slidably connected into the handle 21 and are in one-to-one correspondence with the two clamping rings 22, the two connecting pieces 27 are only allowed to move in a radial direction of the corresponding clamping rings 22, a clamping piece 28 which is located on the inner side of the corresponding clamping ring 22 and is able to mesh with the teeth on the corresponding clamping ring 22 is fixedly arranged at one end of each connecting piece 27, a button 29 is fixedly arranged between outer ends of the two connecting pieces 27, a spring 30 for driving the clamping pieces 28 to move towards the teeth 23 is arranged between the handle 21 and the button 29. A through groove 31 is formed in the handle 21, and the button 29 is arranged in the through groove 31.

When the bidirectional cleaning machine provided by the invention is used for cleaning, the motor 14 of the power mechanism drives the reducer 15 to operate, the reducer 15 then drives the moving gear 16 to rotate, the moving gear 16 drives the base gear 7 to rotate, the base gear 7 drives the outer cleaning ring 6 to rotate by means of the transmission sleeve 5, and at the same time, the base gear 7 drives the connecting shafts 9 to rotate synchronously; because the fixed gear 8 is fixed in the housing 1 and the third gear 11 on the connecting shaft 9 meshes with the fixed gear 8, the third gear 11 rotates around the fixed gear 8 when the connecting shafts 9 rotate with the base gear 7, at the same time, the third gear 11 drives the second gear 10 to rotate synchronously, the second gear 10 drives the first gear to rotate to drive the transmission shaft 2 to rotate in a direction opposite to the rotation direction of the transmission sleeve 5, so the rotation direction of the inner cleaning disk 4 driven by the transmission shaft 2 is opposite to the rotation direction of the outer cleaning ring 6. In this way, bidirectional rotation is realized to fulfill a better cleaning effect. When the relative angle between the handle 21 and the cleaning mechanism needs to be adjusted, the button 29 is pressed, then the button 29 drives the connecting piece 27 to rotate synchronously, the connecting pieces 17 drive the clamping pieces 28 to be separated from the teeth, at the same time, the handle 21 and the cleaning mechanism are unlocked, the handle 21 can be rotated to adjust the relative angle between the handle 21 and the cleaning mechanism. After the relative angle between the handle 21 and the cleaning mechanism is adjusted, the button 29 is released and returns to the initial position under the action of the spring 30 to drive the connecting pieces 27 to move towards one side of the button 29, and the clamping pieces 28 mesh with the clamping teeth 23, such that operation is easy.

The specific embodiments described in the specification are merely used for explaining the spirit of the invention by way of examples. Those skilled in the art can make various amendments, supplements or similar substitutions to the specific embodiments described above without deviating from the spirit of the invention or exceeding the scope defined by the appended claims.

What is claimed is:

1. A bidirectional cleaning machine, comprising a cleaning mechanism and a handle, wherein: the cleaning mechanism comprises a housing, a transmission shaft only allowed to rotate around an axis of the transmission shaft is mounted in the housing, a first gear located in the housing is fixedly arranged on the transmission shaft, and an end of the transmission shaft stretches out of the housing and is fixedly connected to an inner cleaning disk; the transmission shaft is sleeved with a transmission sleeve, wherein the transmission sleeve is only allowed to rotate around an axis of the transmission sleeve, an end of the transmission sleeve stretches out of the housing and is perpendicularly and fixedly connected to an outer cleaning ring, and the outer cleaning ring is disposed around the inner cleaning disk; a base gear located in the housing is fixedly arranged on the transmission sleeve, and a fixed gear coaxial with the transmission shaft is fixedly arranged in the housing; at least two connecting shafts distributed in a circular array around the transmission shaft are perpendicularly arranged on the base gear, and each said connecting shaft is sleeved with a second gear and a third gear, wherein the second gear and the third gear are configured to rotate around a central line of said connecting shaft, the second gear and the third gear are fixedly connected, the second gear meshes with the first gear, and the third gear meshes with the fixed gear;

clamping rings configured as circular structures are fixedly arranged a side face of the housing, teeth are distributed on inner sides of the clamping rings, the handle is rotatably connected between central lines of the clamping rings on the housing, connecting pieces only allowed to slide in a radial direction of the clamping rings are slidably connected to the handle, a clamping piece which is located on the inner side of the corresponding clamping ring and configured to mesh with the teeth on the corresponding clamping ring and is fixedly arranged at an end of each said connecting piece, a button is fixedly arranged at outer ends of the connecting pieces, and a spring for driving the clamping pieces to move towards the teeth is arranged between the handle and the button; a power mechanism for driving the base gear to rotate is fixedly arranged on the housing; the power mechanism comprises a shell fixed to a side face of the housing, a motor and a reducer are fixedly arranged in the shell, a rotating shaft of the motor is connected to an input end of the reducer, and a moving gear meshing with the base gear is arranged at an output end of the reducer; central lines of fixing rings are perpendicular to a length direction of the power mechanism; and the fixing rings are arranged in the clamping rings, wherein the fixing rings are fixed to the housing and each configured as a circular structure, the fixing rings are coaxial with the clamping rings, and the clamping pieces are located between the fixing rings and the clamping rings.

2. The bidirectional cleaning machine according to claim 1, wherein a through groove is formed in the handle, and the button is arranged in the through groove.

3. The bidirectional cleaning machine according to claim 2, wherein two said clamping rings is are fixedly arranged on two sides of the housing, respectively; two said connecting pieces are arranged and are in one to-to-one correspondence with the two clamping rings, and outer ends of the two connecting pieces are fixed to the same button.

4. The bidirectional cleaning machine according to claim 3, wherein two parallel connecting plates are fixedly arranged on the handle, a retaining ring configured as a circular structure is fixedly arranged on an inner side of each said connecting plate, an outer diameter of each of the retaining rings is equal to an inner diameter of each of the fixing rings, the two connecting plates are arranged on two sides of the housing respectively, the two retaining rings on the two connecting plates are sleeved with the two fixing rings respectively, and the handle is rotatably connected to the housing by the retaining rings and the fixing rings.

5. The bidirectional cleaning machine according to claim 1, wherein a connecting ring configured as a circular structure is arranged above the base gear and disposed around the fixed gear, upper ends of the connecting shafts are fixedly connected to the connecting ring, and a number of the connecting shafts is three.

6. The bidirectional cleaning machine according to claim 5, wherein an upper end of the transmission shaft is sleeved with the fixed gear and is only allowed to rotate around an axis of the transmission shaft.

7. The bidirectional cleaning machine according to claim 1, wherein a diameter of the second gear is greater than a diameter of the third gear, a diameter of the first gear is less than a diameter of the fixed gear, and the diameter of the fixed gear is greater than the diameter of the third gear.

8. The bidirectional cleaning machine according to claim 1, wherein a lower surface of the inner cleaning disk is flush with a lower surface of the outer cleaning ring.

* * * * *